US007452223B2

(12) United States Patent
Ha et al.

(10) Patent No.: US 7,452,223 B2
(45) Date of Patent: Nov. 18, 2008

(54) ELECTRICAL CONNECTION DEVICE FOR SLIDE TYPE PORTABLE TERMINAL

(75) Inventors: Dong-In Ha, Seoul (KR); Bong-Do Kim, Yongin-si (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 11/636,782

(22) Filed: Dec. 11, 2006

(65) Prior Publication Data

US 2007/0134956 A1 Jun. 14, 2007

(30) Foreign Application Priority Data

Dec. 9, 2005 (KR) ..... 10-2005-0120340

(51) Int. Cl.
*H01R 13/20* (2006.01)

(52) U.S. Cl. ..... 439/161; 455/575.4

(58) Field of Classification Search ..... 439/162, 439/32, 161; 455/575.4
See application file for complete search history.

(56) References Cited

U.S. PATENT DOCUMENTS

| | | | | |
|---|---|---|---|---|
| 6,483,445 | B1 * | 11/2002 | England | 341/22 |
| 6,524,122 | B1 * | 2/2003 | Johnson et al. | 439/131 |
| 6,618,013 | B1 * | 9/2003 | Aldous | 343/702 |
| 6,766,181 | B1 * | 7/2004 | Newman et al. | 455/575.3 |
| 2005/0221873 | A1 * | 10/2005 | Kameyama et al. | 455/575.4 |

FOREIGN PATENT DOCUMENTS

JP 2003-319042 * 11/2003

* cited by examiner

*Primary Examiner*—Phuong K Dinh
(74) *Attorney, Agent, or Firm*—The Farrell Law Firm, PC

(57) ABSTRACT

An electrical connection device for a slide type portable terminal including a main body and a slide body performing an opening and closing operation with respect to the main body electrically connects a main board of the main body to a sub-board of the slide body, and has one end extendingly connected to a side of the main board and the other end extendingly connected to a side of the sub-board so as to extend and contract at one side or both sides of the terminal according to the opening/closing operation of the slide body.

12 Claims, 4 Drawing Sheets

ELECTRICAL CONNECTION DEVICE FOR SLIDE TYPE PORTABLE TERMINAL

PRIORITY

This application claims priority under 35 U.S.C. § 119 to an application entitled "Electric Connecting Device for Slide Type Portable Terminal" filed in the Korean Intellectual Property Office on Dec. 9, 2005 and assigned Serial No. 2005-120340, the contents of which are incorporated herein by reference.

BACKGROUND OF THE INVENTION

1. Field of the Invention

The present invention relates generally to an electrical connection device between bodies of a slide type portable terminal including a main body and a slide body which slides on the main body to convert its mode into a voice communication mode or other modes, and in particular, to an electrical connection device of a slide type portable terminal configured to maintain excellent reliability of the terminal even when the slide body is operated for a long period of time.

2. Description of the Related Art

With the development of electronics and communication technologies, portable wireless terminals are getting slimmer and lighter, and now provide a greater variety of functions. For example, a portable terminal is now being equipped with a speaker unit that can implement melodies with various chords, and/or with a color display device that has tens or hundreds of thousands of pixels. Also, the terminal may serve as an MP3 player that plays music, or may provide game contents using the display device, together with basic voice-communication functions. Many efforts are being made to further develop those functions.

Also, a portable wireless terminal is being released which provides various functions related to the high-quality color display device. For example, the terminal may be provided with an optical shooting system, such as a small lens assembly, for image communication, digital camera functions, or camcorder functions.

In general, the terminal having the aforementioned functions is a foldable type terminal that includes a main body and a folder. The folder serves as a sub body that is opened with respect to the main body at a predetermined angle.

In addition to the folder type terminal, a slide type terminal is continuously being released. The slide type terminal is opened by sliding a slide body over a predetermined distance on the main body in a lengthwise direction of the terminal. When closed (i.e., slid down), the slide body overlaps the main body and thus the terminal can be carried while having an overall size of the main body. Also, during voice communication (when the slide body is slid up), the terminal is opened to have a similar size to the opened folder type terminal, thereby allowing operations to be performed under advantageous communication environments.

In the aforementioned slide type terminal, a main board (RF board) with a controller and a battery pack serving as a power supply unit are generally mounted on the main body. Also, the slide body is equipped with a display device and various key buttons. For this reason, an electrical connection device is used to electrically connect the main body to the slide body. In general, a flexible printed circuit (FPC) is used as the electrical connection device and is installed on a surface where the main body surface-contacts with the slide body. The FPC is installed with an extra portion long enough to move the slide body, and therefore, is generally formed in the shape of 'S' on a surface where the main body surface-contacts with the slide body. The 'S'-shaped FPC extends and contracts according to the operation of the slide body.

However, because the FPC is installed in the form of 'S' on a surface where a the main body surface-contacts with the slide body, the terminal increases in volume, and frequent opening/closing operation of the slide body can cause an open circuit of the FPC, and consequently, malfunction of the terminal occurs.

SUMMARY OF THE INVENTION

An object of the present invention is to substantially solve at least the above problems and/or disadvantages and to provide at least the advantages below. Accordingly, an object of the present invention is to provide an electrical connection device for a slide type portable terminal configured to secure reliability even though the terminal is operated over a long period of time.

Another object of the present invention is to provide an electrical connection device for a slide type portable terminal configured to prevent malfunction of a terminal due to an open circuit or twist caused by fatigue, even though opening/closing operations of the terminal are performed over a long period of time.

A further object of the present invention is to provide an electrical connection device for a slide type portable terminal configured to prevent an increase in volume of the terminal as much as possible.

According to an aspect of the present invention, an electrical connection device for a slide type portable terminal, which includes a main body and a slide body which slides on the main body to open or close the terminal, electrically connects a main board of the main body to a sub board of the slide body. Here, one end of the electrical connection unit is connected to a side of the main board and the other end thereof is connected to a side of the sub-board, so that the electrical connection unit extends and contracts at one side or both sides of the terminal according to the opening/closing operation of the slide body.

BRIEF DESCRIPTION OF THE DRAWINGS

The above and other objects, features, and advantages of the present invention will become more apparent from the following detailed description when taken in conjunction with the accompanying drawings in which.

DETAILED DESCRIPTION OF THE PREFERRED EMBODIMENTS

Preferred embodiments of the present invention will be described herein below with reference to the accompanying drawings. In the following description, well-known functions or constructions are not described in detail because they would obscure the present invention in unnecessary detail.

Figure 1:
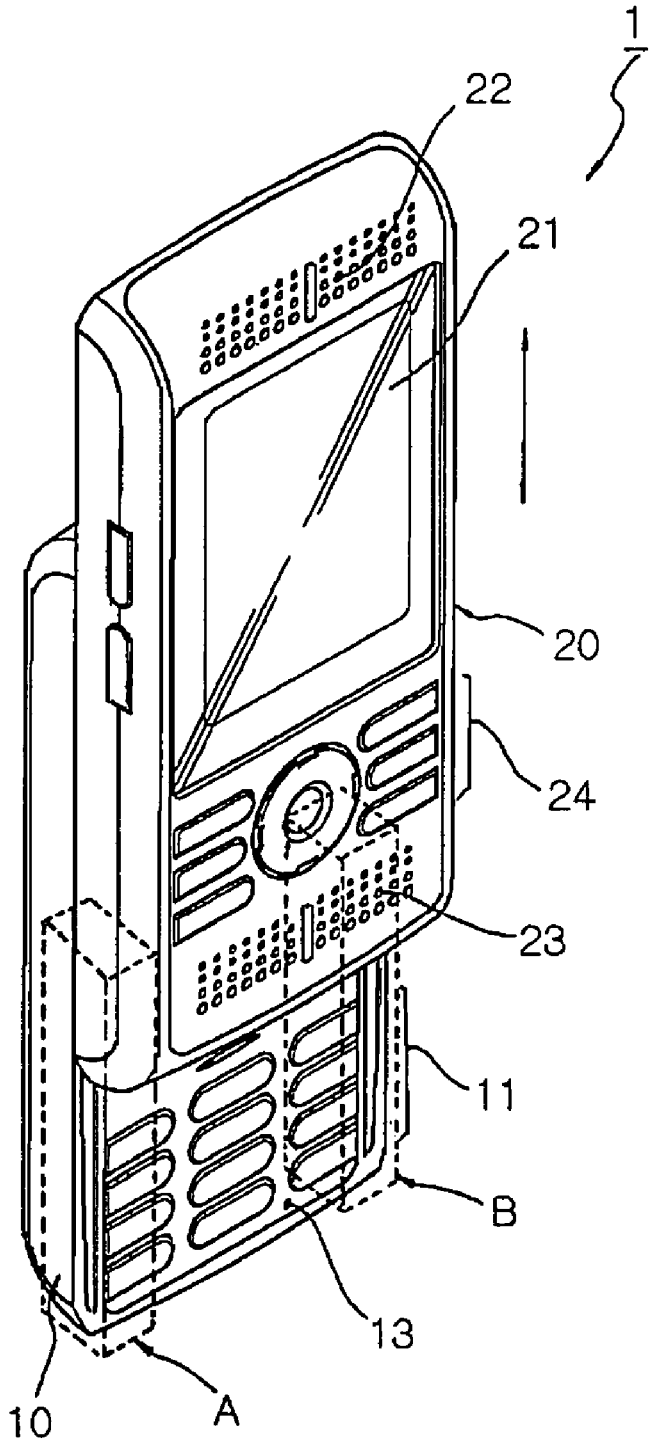
FIG. 1 is a perspective view of a portable terminal employing an electrical connection device according to the present invention.

FIG. 1 is a perspective view of a portable terminal using an electrical connection device according to the present invention, illustrating a slide-type portable terminal 1 including a main body 10 and a slide body 20 which slides over a predetermined distance in the lengthwise direction of the terminal 1, (i.e., in the direction of the arrow in FIG. 1).

A keypad assembly 11 having a plurality of key buttons is installed on a surface of the main body 10 viewed when the slide body 20 slides up to open the terminal 1. The key buttons of the keypad assembly 11 are preferably formed in a 3×4 array configuration. A microphone 13 is installed under the keypad assembly 11.

A display unit 21 having a predetermined size is installed on the slide body 20. The display unit 21 may be a high-quality color wide TFT (thin film transistor) LCD (liquid crystal display) module. Function key buttons including navigation key buttons are configured into one keypad assembly 24 under the display unit 21. Speaker units 22 and 23 are provided above and below the display unit 21, and two speaker units may be installed to produce stereo sounds.

Because the main body 10 and the slide body 20 slide relative to each other, an electrical connection device that connects the main body 10 to the slide body 20 is used for data transmission, power supply, and the like. Preferably, the electrical connection device has an extra portion long enough to cope with the sliding of the slide body 20, and is able to prevent an open circuit due to abrasion or fatigue even though the sliding body 20 is frequently slid over a long period of time.

Therefore, according to the present invention, the electrical connection device is installed at a side of the terminal, not at a portion where the main body and the slide body make surface-contact. That is, the electrical connection device is installed at a part 'A' indicated by the dotted line of FIG. 1, thereby preventing abrasion occurring when the electrical connection device is installed at a portion where surface contact therebetween is made. If necessary, the electrical connection device may be installed at a part B illustrated as the dotted line in FIG. 1, or may be installed at both parts A and B. Also, a flexible printed circuit (FPC) is used as the electrical connection device in the present invention, and it may be formed in a mono-layered or multi-layered structure.

Figure 2:
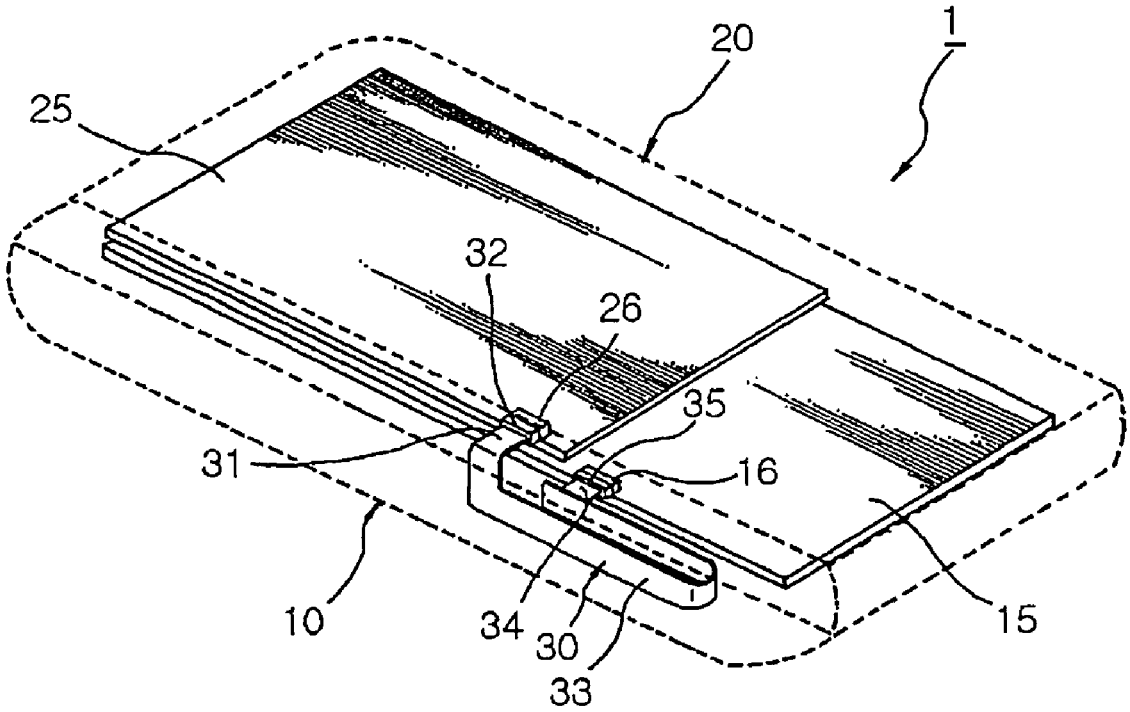
FIG. 2 is a perspective view of a main body of the portable terminal employing an electrical connection device according to the present invention.

FIG. 2 is a perspective view of a main body of the portable terminal using the electrical connection device according to the present invention. A main board 15 is mounted in the main body 10. Although not shown in the drawing, an electronic function group including a control chip may be mounted according to the use of the terminal. Also, a printed circuit board (PCB) or an FPC is installed as a sub-board 25 on the slide body 20. An LCD module (not shown) is mounted as a display unit on the sub-board 25. Accordingly, an electrical connection device is required for power supply from a battery pack installed on the main body 10 and overall control on the slide body 20 through a control chip installed on the main board 15 of the main body 10.

According to the present invention, an FPC 30 having a certain width is used as the electrical connection device. Furthermore, the FPC 30 is installed to protrude at a side, not at a portion where the main board 15 and the sub-board 25 make surface-contact. One end 34 of the FPC 30 is electrically connected to a side surface of the main board 15, and the other end 31 is electrically connected to a side surface of the sub-board 25. Preferably, a central connection portion 33 of the FPC 30 is disposed at a side surface of each board 15 and 25 in the shape of a 'U' when viewed from the front of the terminal. Thus, the FPC has an extra portion long enough to allow sliding of the slide body 20. More preferably, both ends 31 and 34 of the FPC 30 may be electrically connected with the boards 15 and 25 by predetermined connectors. For example, male connectors 32 and 35 are installed at both ends of the FPC 30, and female connectors 26 and 16 are installed on the boards 15 and 25, so that the FPC 30 can be electrically connected or disconnected. However, the present invention is not limited thereto, and a well-know electrical connection method or device may be used. For example, a soldering process may be performed between both ends of the FPC and corresponding circuit patterns of the main and sub boards, thereby preventing an increase in the thickness and volume of the terminal.

Figure 3:
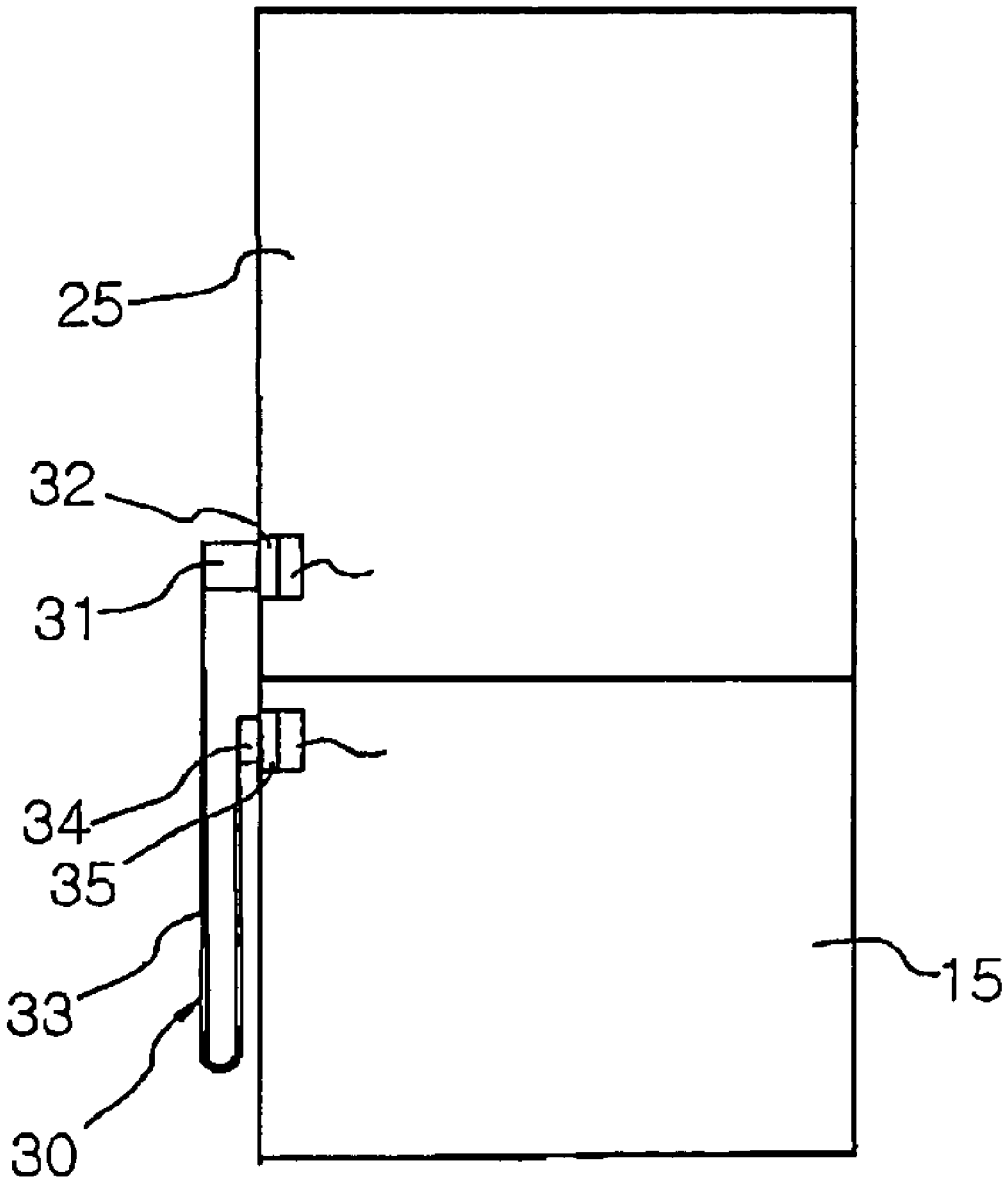
FIGS. 3 and 4 are sectional views illustrating operations of the electrical connection device according to a movement of a sub board according to the present invention.
Figure 4:
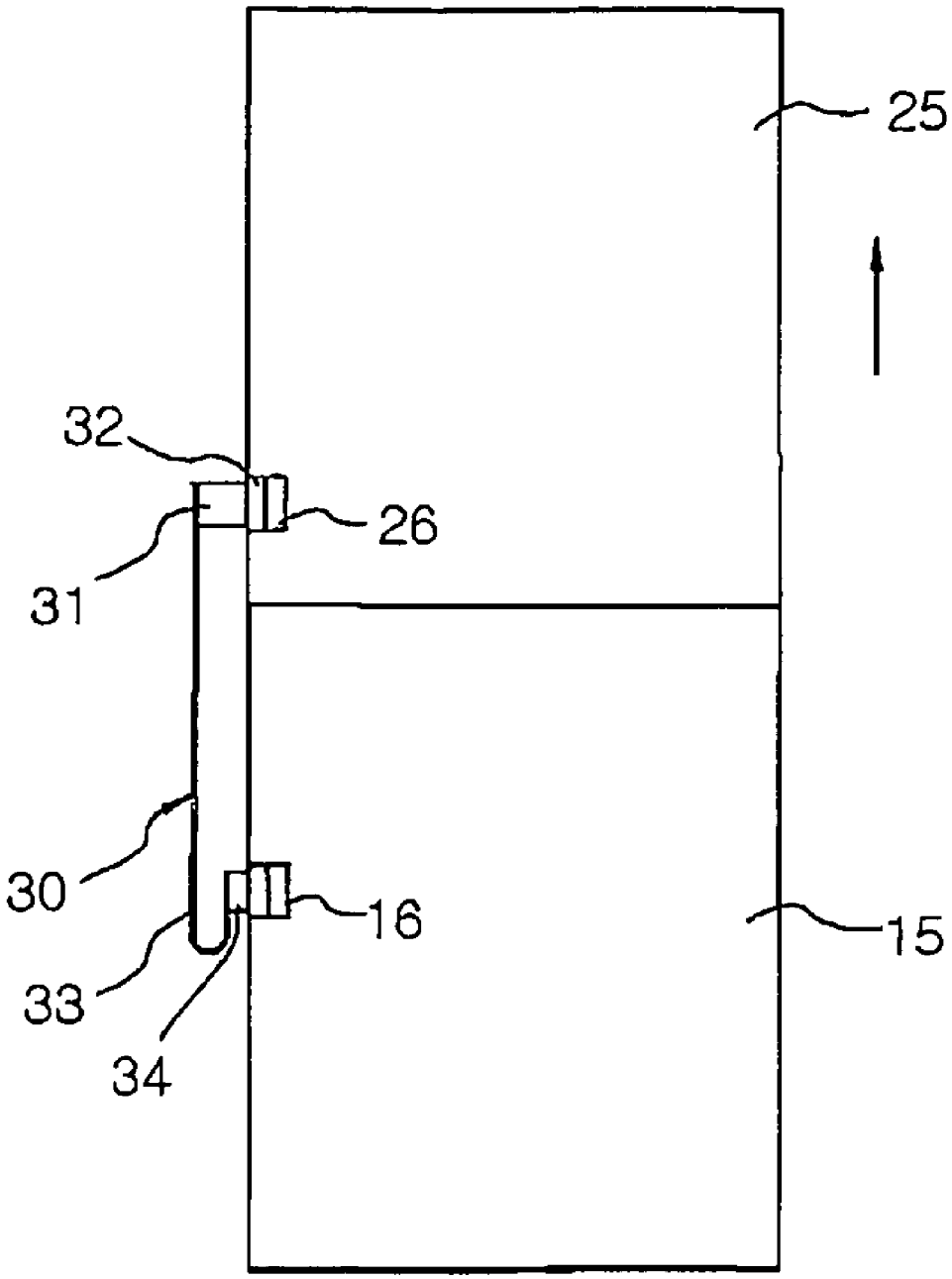

FIGS. 3 and 4 are sectional views illustrating an operation of the electrical connection device in accordance with the movement of the sub board. For the purpose of simplicity in description, the movement between the main board 15 mounted in the main body and the sub-board 25 mounted in the slide body is illustrated in those drawings. It is apparent that the slide body is moved as much as the sub-board 25 is moved.

In FIG. 3, the slide body 20 overlaps the main body 10, that is, the terminal is in a closed state, and the FPC 30 is disposed in the form of 'U' at the side of each board 15 and 25. Here, if a user slides up the slide body 20 to open and use the terminal for voice communication or other functions, the FPC 30 may be lengthened to a predetermined length as illustrated in FIG. 4.

Unlike the conventional terminals in which an electrical connection device is operated, undergoing friction between exteriors of the bodies, in the present invention, the FPC 30 used as a connection unit is operated in the slide body or the main body of the terminal so that friction of peripheral components does not occur even during the long-time operation of the terminal.

According to the present invention, an inter-board electrical connection device is installed at a side space of the terminal. Thus, even if the terminal is operated for a long period of time, an open circuit or the like due to fatigue or friction does not occur. Accordingly, mal-function of the terminal may be prevented, and the thickness and volume of the terminal may be reduced.

While the present invention has been shown and described with reference to certain preferred embodiments thereof, it will be understood by those skilled in the art that various changes in form and details may be made therein without departing from the spirit and scope of the present invention as defined by the appended claims.

What is claimed is:

1. An electrical connection device for a slide type portable terminal including a main body and a slide body configured to perform opening and closing operations with respect to the main body, the electrical connection device electrically connecting a main board of the main body to a sub board of the slide body, the sub board sliding on a slide path with respect to the main board, the electrical connection device comprising:

a first end connected to a first side of the main board;

a second end connected to a second side of the sub-board, the second side overlying the first side; and a central connection portion for electrically connecting the first end and the second end, the central connection region being positioned outside the maximum of the combined surface areas of the main board and the sub board and lateral of the direction of the slide path.

2. The electrical connection device of claim 1, wherein the electrical connection device extends and contracts within one of the main body and the slide body according to the operation of the slide body.

3. The electrical connection device of claim 2, wherein the electrical connection device is an FPC (flexible printed circuit) having a predetermined width and formed in one of a mono-layered and multi-layered structure.

4. The electrical connection device of claim 3, wherein the FPC is installed in the form of a 'U'.

5. The electrical connection device of claim 4, wherein the FPC has both ends soldered to circuit patterns of the main board and the sub-board, respectively.

6. The electrical connection device of claim 4, wherein the FPC includes at both ends, one of female connectors and male connectors to be coupled to corresponding male connectors and female connectors mounted on the main board and the sub-board.

7. A portable terminal comprising;

a main body;

a slide body configured to perform opening and closing operations with respect to the main body; and an electrical connection device for electrically connecting a main board of the main body to a sub board of the slide body, the sub board sliding on a slide path with respect to the main board, the electrical connection device comprising a first end connected to a first side of the main board, a second end connected to a second side of the sub-board, the second side overlying the first side, a central connection portion for electrically connecting the first end and the second end, the central connection region being positioned outside the maximum of the combined surface areas of the main board and the sub board and lateral of the direction of the slide path.

8. The portable terminal of claim 7, wherein the electrical connection device extends and contracts within one of the main body and the slide body according to the operation of the slide body.

9. The portable terminal of claim 8, wherein the electrical connection device is an FPC (flexible printed circuit) having a predetermined width and formed in one of a mono-layered and multi-layered structure.

10. The portable terminal of claim 9, wherein the FPC is installed in the form of a 'U'.

11. The portable terminal of claim 10, wherein the FPC has both ends soldered to circuit patterns of the main board and the sub-board, respectively.

12. The portable terminal of claim 10, wherein the FPC includes at both ends, one of female connectors and male connectors to be coupled to corresponding male connectors and female connectors mounted on the main board and the sub-board.

* * * * *